US008459152B2

(12) United States Patent
Keong et al.

(10) Patent No.: US 8,459,152 B2
(45) Date of Patent: Jun. 11, 2013

(54) OPEN-END WRENCH AND METHOD OF MANUFACTURING THE SAME

(75) Inventors: Chi-Wah Keong, Kaohsiung (TW); Po-Yu Hung, Keohsiung County (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 258 days.

(21) Appl. No.: 12/980,816

(22) Filed: Dec. 29, 2010

(65) Prior Publication Data

US 2012/0167724 A1 Jul. 5, 2012

(51) Int. Cl.
*B25B 13/08* (2006.01)
*B21K 5/16* (2006.01)

(52) U.S. Cl.
USPC ..... 81/119; 76/114

(58) Field of Classification Search
USPC ..... 81/119, 186, 900; 76/114
See application file for complete search history.

(56) References Cited

U.S. PATENT DOCUMENTS

| | | | | | |
|---|---|---|---|---|---|
| 463,137 | A * | 11/1891 | Carpenter | 81/125.1 |
| 908,677 | A * | 1/1909 | Jones | 81/119 |
| 1,314,044 | A * | 8/1919 | Buker | 81/185 |
| 2,909,954 | A * | 10/1959 | Rhoads | 81/186 |
| 3,360,291 | A * | 12/1967 | Barrett | 81/119 |
| 5,062,328 | A * | 11/1991 | Demurger | 81/186 |
| 6,339,980 | B1 * | 1/2002 | Woolf | 81/185.1 |
| 7,117,767 | B1 * | 10/2006 | Kiat | 81/125.1 |
| 7,237,462 | B1 * | 7/2007 | Liau | 81/177.1 |

* cited by examiner

*Primary Examiner* — David B Thomas
(74) *Attorney, Agent, or Firm* — Muncy, Geissler, Olds & Lowe, PLLC

(57) ABSTRACT

An open-end wrench and a method of manufacturing the same are provided, the structure of which includes a body and a cover. The body includes a head portion and a handle portion, and the head portion includes a jaw portion and an opening formed at an inner side of the jaw portion. The cover includes a first plate, a second plate, and a third plate connecting the first plate and the second plate. An external surface of the third plate is formed to a wrench opening. A mouth is defined by external edges of the first plate, the second plate, and the third plate, and the mouth is penetrated by the jaw portion, so the cover wraps the jaw portion and the head portion is imbedded to the cover by using adhesive means.

20 Claims, 5 Drawing Sheets

OPEN-END WRENCH AND METHOD OF MANUFACTURING THE SAME

BACKGROUND OF THE INVENTION

1. Field of Invention

The present invention relates to an open-end wrench and a method of manufacturing the same, and more particularly to an open-end wrench made of two different materials and a method of manufacturing the same.

2. Related Art

As shown in FIG. 1, a conventional open-end wrench 10 is integrally formed of steel. Although an wrench opening 111 of a head portion 11 thereof is strong enough to screw on or off a screw, and a handle portion 12 thereof has a certain strength to provide enough torque torsion rigidity, an overall weight may be heavy, and especially, when the wrench is used on a large-size screw and is carried, stored, delivered, and used in high altitude operation (such as a telecom tower and a steel truss arch bridge), the wrench is unable to satisfy a light weight requirement of a user. Especially, in a filed where the light weight wrench is required, for example, a drilling platform, wind power generation, pylon, mountain climbing or mountain areas, a conventional pure-steel wrench is usually criticized due to its heavy weight but has to be accepted.

Another problem is that if the open-end wrench 10 is made of light alloy for a light weight, a wrench opening thereof does not have enough strength to screw on or off a steel screw.

SUMMARY OF THE INVENTION

The present invention is directed to a structure of an open-end wrench, which uses a material with high rigidity as a head portion and a material with lower rigidity as a body and a handle portion, and a method of manufacturing the same.

To achieve the objective, the present invention provides a method of manufacturing an open-end wrench, which comprises the following steps. First, a body is provided, the body comprises a head portion and a handle portion, and the head portion comprises an opening. Next, a cover made of a material different from that of the body is female jointed around the head portion. The cover wraps a jaw portion of the body, and the head portion is imbedded to the cover by using adhesive means. An external surface of the cover corresponding to the opening is formed to a wrench opening, so as to join a head end of a screw to screw on or off the screw.

The cover is female jointed to the body is by using adhesive means.

The head portion and the handle portion are integrally formed.

To achieve the objective, the present invention provides an open-end wrench for screwing on or off a screw, which comprises a body and a cover. The body comprises a head portion and a handle portion. The head portion comprises a jaw portion and an opening formed at an inner side of the jaw portion. The cover comprises a first plate, a second plate, and a third plate connecting the first plate and the second plate. An external surface of the third plate is formed to a wrench opening. A mouth is defined by external edges of the first plate, the second plate, and the third plate together. The mouth is penetrated by the jaw portion, so the cover wraps the opening of the head portion and is engaged and adhesive with the head portion.

The cover has higher material rigidity than that of the body. A working width of the wrench opening may be greater than or equal to 32 mm. An outer side of the jaw portion is exposed outside the cover.

The body of the present invention is made of light alloy, and the cover is made of a steel material with high rigidity. A weight of the wrench can be greatly reduced by using the light-weight and large-volume body and the cover with the high rigidity and by female jointing the body inside the cover using an adhesive process. By using a design of different materials and a joint in the present invention, good feature of the original material is well kept, and after the different materials are joined, the rigidity of the wrench opening of the wrench can be maintained, and the light-weight advantage is achieved.

DETAILED DESCRIPTION OF THE INVENTION

The preferred embodiment of the present invention is illustrated in detail below with reference to the accompanying drawings.

Figure 1:
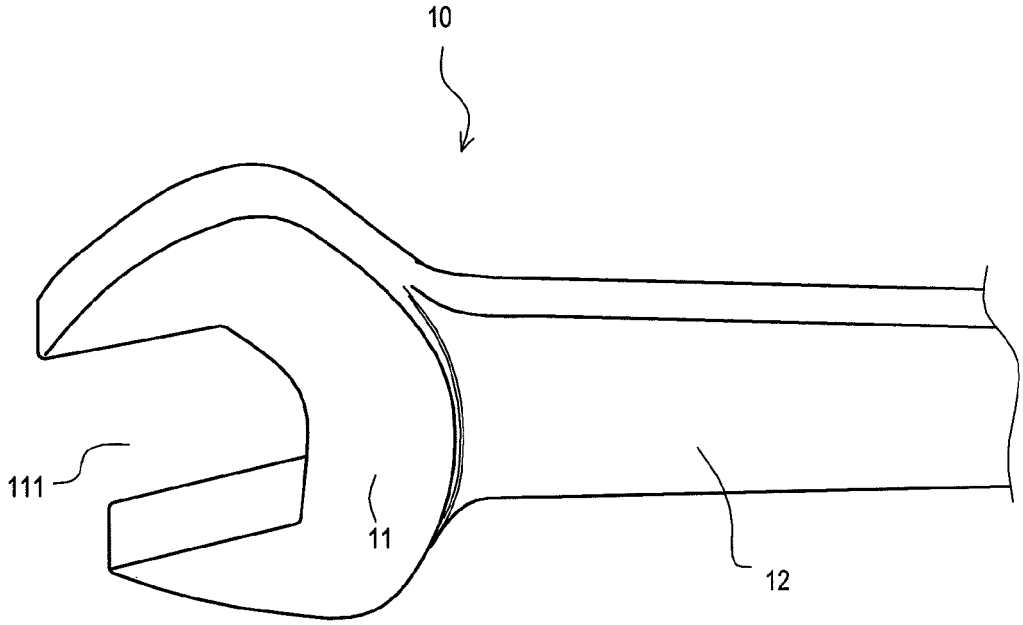
FIG. 1 is a three-dimensional view of a conventional open-end wrench.
Figure 2:
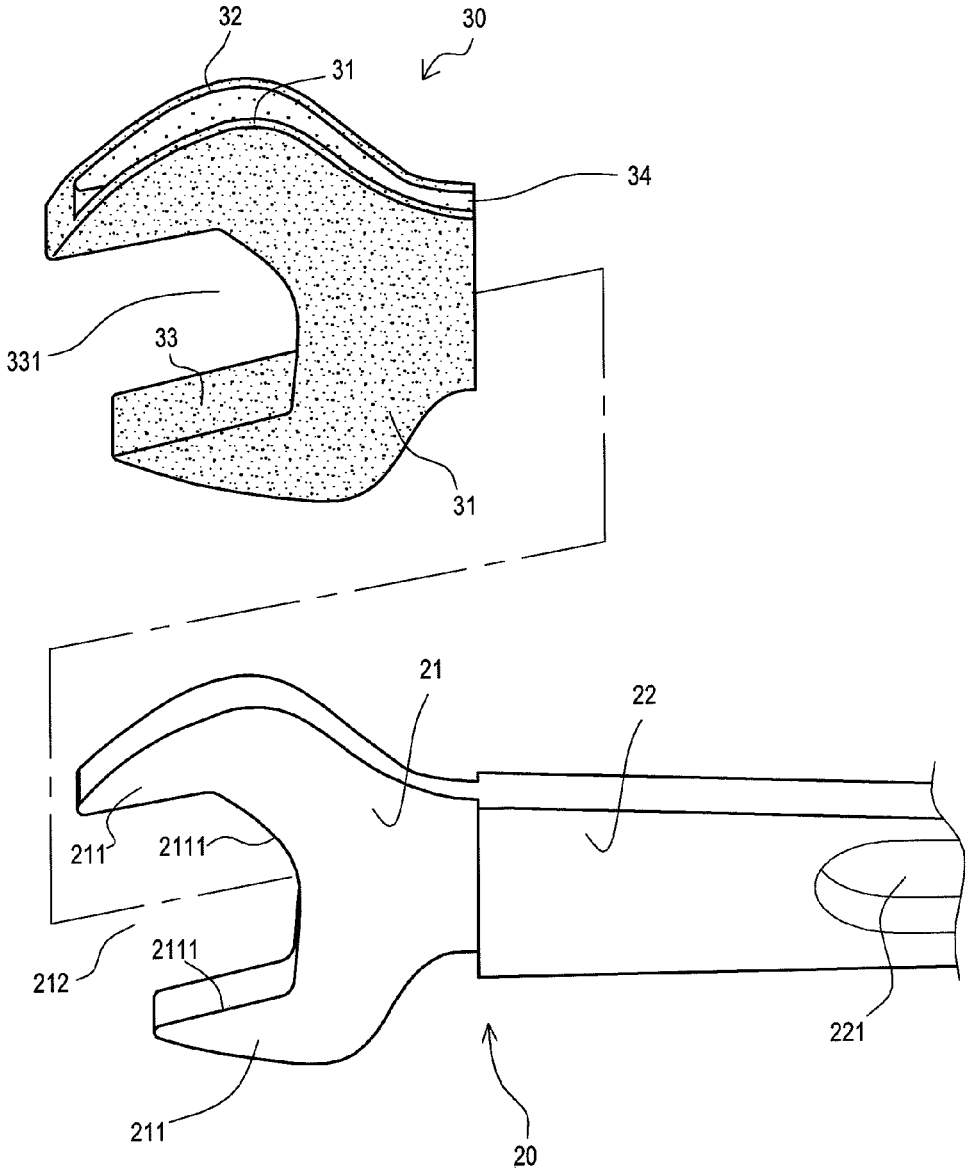
FIG. 2 is a three-dimensional exploded view of a joint of a body and a cover of an open-end wrench according to an embodiment of the present invention.
Figure 3:
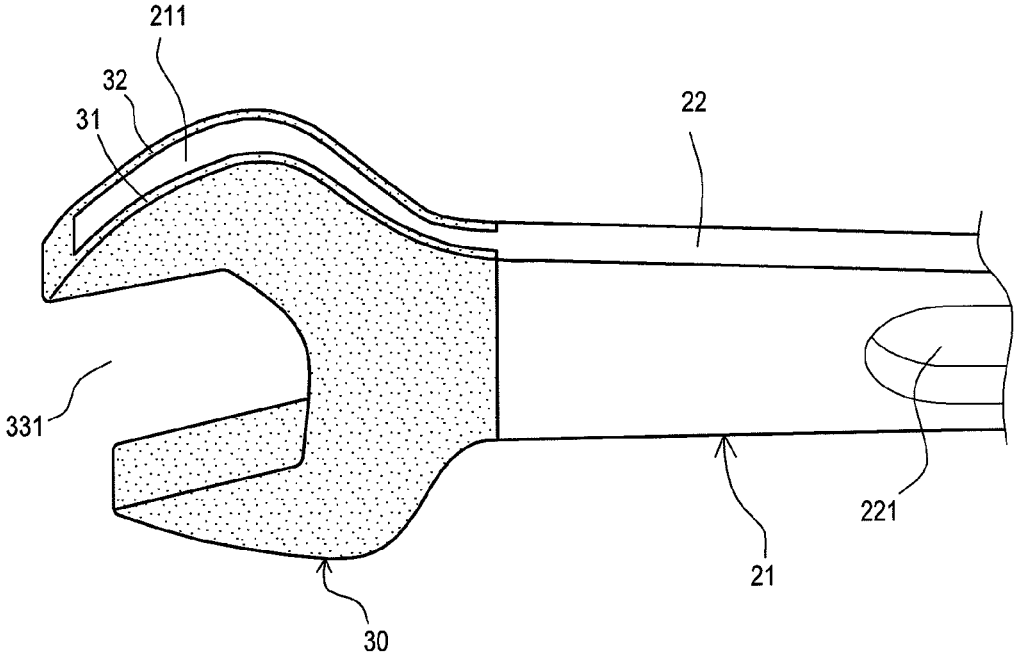
FIG. 3 is a three-dimensional assembled view of FIG. 2.
Figure 4:
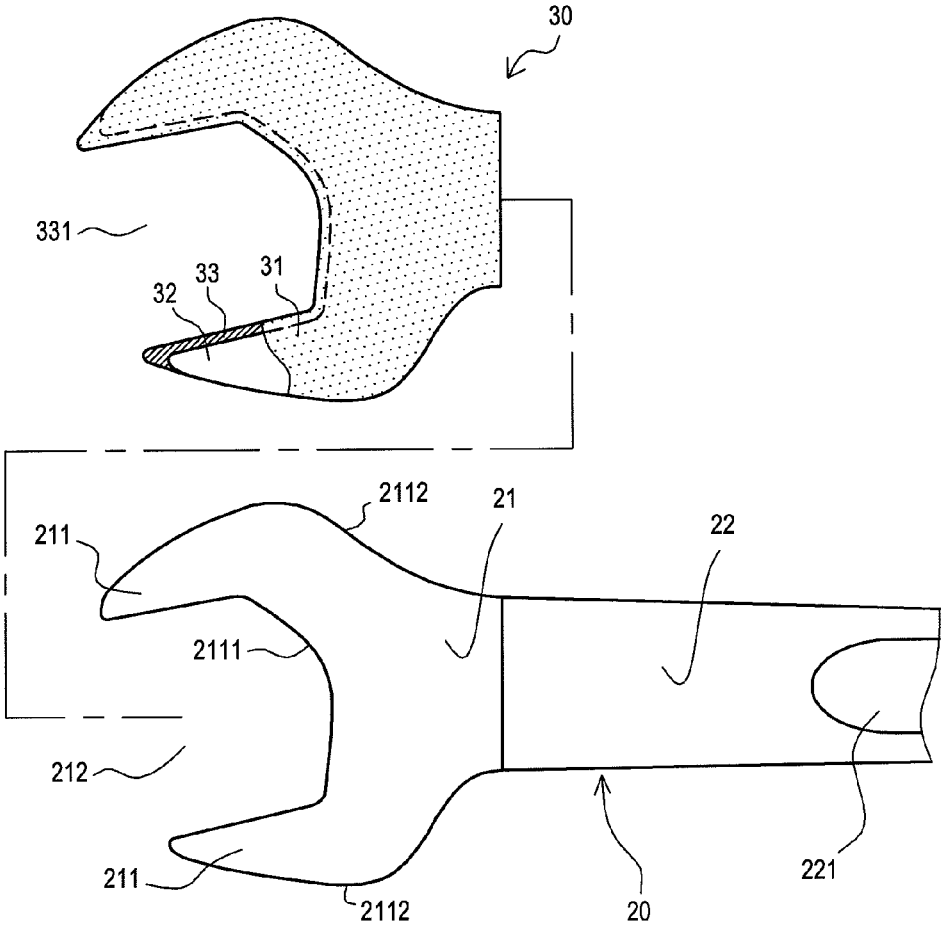
FIG. 4 is a front view of FIG. 2.
Figure 5:
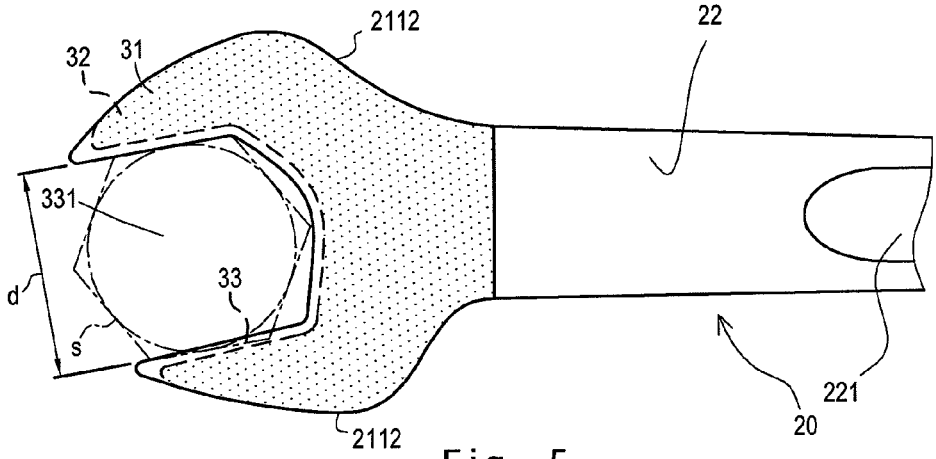
FIG. 5 is a front view of FIG. 3.

As shown in FIG. 2 to FIG. 5, an open-end wrench according to an embodiment of the present invention is used for screwing on or off a screw s (as shown in FIG. 5), in which a structure of the open-end wrench includes a body 20 and a cover 30. The body 20 includes a head portion 21 and a handle portion 22 connected thereto. The head portion 22 further includes a jaw portion 211, wherein an inner side 2111 of the jaw portion 211 is formed to an opening 212 which is similar to an U-shape. The cover 30 includes a first plate 31, a second plate 32 corresponding to the first plate 31, and a third plate 33 connecting the first plate 31 and the second plate 32. An external surface of the third plate 33 is curved to form a wrench opening 331. The wrench opening 331 is used for screwing on or off a screw s (as shown in FIG. 5). Together, the configurations of the first plate 31, the second plate 32, and the third plate 33 define a mouth 34 (as shown in FIG. 2 and FIG. 4). The cover 30 is female jointed to the body 20 are joined by using adhesive means, but the embodiment is not limited thereto. The mouth 34 can be penetrated by the jaw portion 211 of the body 20, such that the third plate 33 of the cover 30 may correspond to a position of the opening 212 and wraps the jaw portion 211, such that the head portion is imbedded to the cover 30 by using adhesive means (as shown in FIG. 3 and FIG. 5). The wrench opening 331 contacting the screw head, the first plate 31 and the second plate 32 connected to the wrench opening 331 are made of a same material and integrally formed.

In the embodiment, material rigidity of the cover 30 is greater than those of the body 20, so as to ensure the rigidity required for screwing on or off the screw. Furthermore, a material density of the cover 30 is greater than a material density of the main body 20, so as to achieve a light-weight advantage.

Furthermore, in the embodiment, if a working width d of the wrench opening 331 (namely, a width of the wrench opening 331) is larger, indicating that a relative volume of the open-end wrench is larger, a light weight of the open-end wrench then becomes more important. For example, when the working width d of the wrench opening 331 is equal to or greater than 32 mm, the advantage of the light-weight of the composite materials while maintaining the rigidity required for the wrench opening 331 in the embodiment becomes more obvious.

In the embodiment, an outer side 2112 of the jaw portion 211 of the head portion 21 corresponding to the inner side 2111 is partially exposed outside the cover 30, so as to form an aspect that the first plate 31 and the second plate 32 sandwich the jaw portion 211. Of course, a part of the first plate and a part of the second plate may be extendably formed to a part of the handle portion 22, so as to provide a better torque stress for the body 20, and at least a hole 221 (or an open groove) may also be provided at the handle portion 22, so as to reduce the weight of the body 20.

Figure 6:
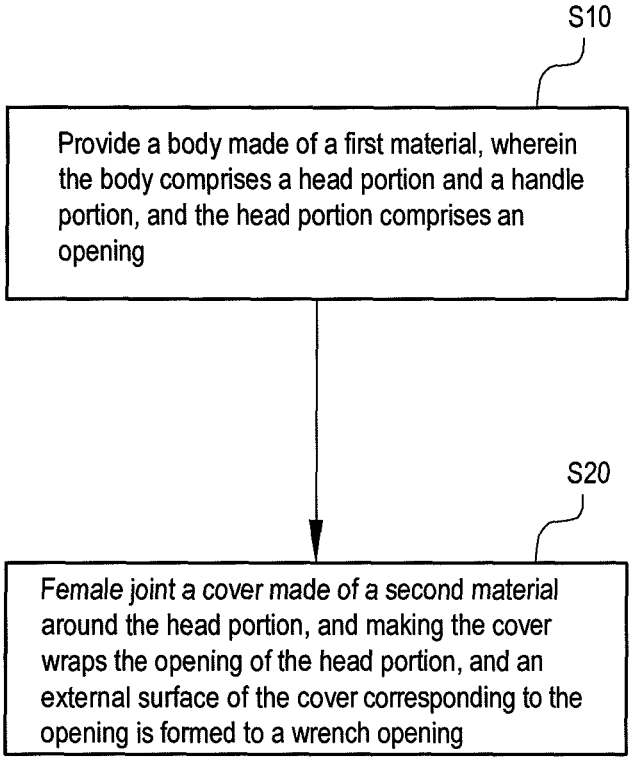
FIG. 6 is a flow chart of a method of manufacturing an open-end wrench according to an embodiment of the present invention.

Refer to FIG. 6 in combination with FIG. 4 and FIG. 5. A method of manufacturing an open-end wrench according to an embodiment of the present invention is provided, which includes the following steps. In Step S10, a body 20 of a first material is provided. The body 20 includes a head portion 21 and a handle portion 22. The head portion 21 includes an opening 212. In Step S20, a cover 30 made of a second material is female jointed outside the head portion 21. The cover 30 wraps the opening 212 of the head portion 21. An external surface of the cover 30 corresponding to the opening 212 is formed to a wrench opening 331. The wrench opening 331 is used for screwing on or off a screw s. The female joint between the cover 30 and the body 20 may use adhesive means (but the embodiment is not limited thereto).

In the embodiment, the first material may be aluminum, magnesium, iron or other alloy, and the second material may be die steel, chrome molybdenum steel or chrome vanadium steel.

In an embodiment of the present invention, through the above design, the body 20 is made of the first material (for example, aluminum alloy), and the cover 30 is made of the second material (for example, the chrome molybdenum steel). After experiments, the wrench can reach the wrench standard commercial torque requirement (643 N-M) of the Deutches Industrie Norm DIN-3113, the torque reaches 743.524 N-M~1141.639 N-M, and the weight of the wrench is expected to decrease by 38%~40% compared with a pure-steel wrench.

The feature of the present invention lies in that, the body of the present invention is made of the light alloy, and the cover is made of the die steel, chrome molybdenum steel or the steel material with high rigidity. The light-weight and large volume body can be adopted, the wrench opening of the cover with high rigidity contacts and works with the screw, and the body is female jointed inside the cover through the adhesive process, so the weight of the wrench can be greatly reduced. By using the design of different materials and the joint in the present invention, the advantage of the original material is well kept, and after the different materials are joined, the rigidity of the jaw portion of the wrench can be maintained, so the light-weight advantage is produced.

The above descriptions are merely preferred embodiments of technical solutions employed in the present invention to solve the problem, and are not intended to limit the scope of the present invention. All equivalent replacements or modifications conforming to the claims of the present invention or made according to the claims of the present invention shall fall within the scope of the present invention.

What is claimed is:

1. A method of manufacturing an open-end wrench, comprising:

providing a body made of a first material, wherein the body comprises a head portion and a handle portion, and the head portion comprises an opening; and female jointing a cover made of a second material around the head portion, wherein the cover comprises a first plate, a second plate and a third plate, the second plate corresponds to the first plate, the third plate is connected between the first plate and the second plate, an external surface of the third plate corresponding to the opening is formed to a wrench opening, and the first, second and third plates of the cover define a mouth having a receiving space being the same as the volume of the head portion, whereby the cover wraps the opening of the head portion.

2. The method of manufacturing an open-end wrench according to claim 1, wherein the cover is the female jointed to the body is by using adhesive means.

3. The method of manufacturing an open-end wrench according to claim 1, wherein the head portion and the handle portion of the body are integrally formed.

4. The method of manufacturing an open-end wrench according to claim 1, wherein the first material is one of aluminum, magnesium and iron.

5. The method of manufacturing an open-end wrench according to claim 1, wherein the second material is one of die steel, chrome molybdenum steel and chrome vanadium steel.

6. An open-end wrench, comprising:

a body, comprising a head portion and a handle portion, wherein the head portion comprises a jaw portion and an opening formed at an inner side of the jaw portion; and a cover, comprising a first plate, a second plate corresponding to the first plate, and a third plate connected between the first plate and the second plate, wherein an external surface of the third plate is formed to a wrench opening, external edges of the first plate, the second plate, and the third plate define a mouth, the mouth is penetrated by the jaw portion of the body, and the mouth having a receiving space being the same as the volume of the head portion so the cover wraps the jaw portion, and the cover is female jointed around the head portion by using adhesive means.

7. The open-end wrench according to claim 6, wherein material rigidity and density of the cover are greater than material rigidity and density of the body.

8. The open-end wrench according to claim 6, wherein a working width of the wrench opening ≧32 mm.

9. The open-end wrench according to claim 6, wherein an outer side of the jaw portion corresponding to the inner side is partially exposed outside the cover.

10. The open-end wrench according to claim 6, wherein a part of the first plate and a part of the second plate are extendably formed to a part of the handle portion.

11. The open-end wrench according to claim 6, wherein the handle portion comprises at least a hole, so as to reduce weight.

12. The open-end wrench according to claim 6, wherein the body is made of one of aluminum, magnesium and iron.

13. The open-end wrench according to claim 6, wherein the cover is made of one of die steel, chrome molybdenum steel and chrome vanadium steel.

14. An open-end wrench, comprising:

a body, comprising a head portion; and a cover, female jointed around the head portion by using adhesive means, and comprising a first plate, a second plate corresponding to the first plate, and a third plate connected between the first plate and the second plate, wherein an external surface of the third plate is formed to a wrench opening, the first, second and third plates of the cover define a mouth having a receiving space being the same as a volume of the head portion, and material rigidity and density of the cover are greater than material rigidity and density of the body.

15. The open-end wrench according to claim 14, wherein a working width of the wrench opening ≧32 mm.

16. The open-end wrench according to claim 14, wherein an outer side of the jaw portion corresponding to the inner side is partially exposed outside the cover.

17. The open-end wrench according to claim 14, wherein a part of the first plate and a part of the second plate are extendably formed to a part of the handle portion.

18. The open-end wrench according to claim 14, wherein the handle portion comprises at least a hole, so as to reduce weight.

19. The open-end wrench according to claim 14, wherein the body is made of one of aluminum, magnesium and iron.

20. The open-end wrench according to claim 14, wherein the cover is made of one of die steel, chrome molybdenum steel and chrome vanadium steel.

* * * * *